US006095892A

United States Patent [19]

Moe

[11] Patent Number: 6,095,892

[45] Date of Patent: Aug. 1, 2000

[54] MOTORCYCLE RACE TRACK WITH MOVING RIDER FIGURINES

[76] Inventor: Courtney A. Moe, 82 Palmer Court Shewsbury Crescent, Brent, London N.W.10, United Kingdom

[21] Appl. No.: 09/213,109

[22] Filed: Dec. 17, 1998

[51] Int. Cl.[7] ..... A63H 17/16; A63H 17/18; A63H 17/21

[52] U.S. Cl. ..... 446/440; 446/441; 446/431; 446/444; 446/446; 446/455; 446/460; 446/468

[58] Field of Search ..... 446/440, 443, 446/445, 441, 444, 446, 455, 460, 467, 468

[56] References Cited

U.S. PATENT DOCUMENTS 2,631,853 3/1953 Haynes ..... 463/59

3,618,258 11/1971 Clark ..... 446/446

FOREIGN PATENT DOCUMENTS 2096905A 10/1982 United Kingdom ..... 446/446

2215626A 9/1989 United Kingdom ..... 446/460

*Primary Examiner*—Robert A. Hafer

*Assistant Examiner*—Bena B. Miller

[57] ABSTRACT

A model motorcycle race track system is provided including a race track and a plurality of carriage assemblies slidable along the track. A plurality of miniature motorcycles are each mounted on one of the carriage assemblies for being moved around the track.

12 Claims, 5 Drawing Sheets

MOTORCYCLE RACE TRACK WITH MOVING RIDER FIGURINES

BACKGROUND OF THE INVENTION

1. Field of the Invention

The present invention relates to model race tracks and more particularly pertains to a new motorcycle race track with moving rider figurines for providing a motorcycle track having model motorcycles and rider figurines with life-like motion.

2. Description of the Prior Art

The use of model race tracks is known in the prior art. More specifically, model race tracks heretofore devised and utilized are known to consist basically of familiar, expected and obvious structural configurations, notwithstanding the myriad of designs encompassed by the crowded prior art which have been developed for the fulfillment of countless objectives and requirements.

Known prior art model race tracks include U.S. Pat. No. 3,410,223; U.S. Pat. No. 4,537,577; U.S. Pat. No. 3,708,913; U.S. Pat. No. 3,313,242; U.S. Pat. No. 4,079,938; and U.S. Pat. No. 4,438,590.

In these respects, the motorcycle race track with moving rider figurines according to the present invention substantially departs from the conventional concepts and designs of the prior art, and in so doing provides an apparatus primarily developed for the purpose of providing a motorcycle track having model motorcycles and rider figurines with life-like motion.

SUMMARY OF THE INVENTION

In view of the foregoing disadvantages inherent in the known types of model race tracks now present in the prior art, the present invention provides a new motorcycle race track with moving rider figurines construction wherein the same can be utilized for providing a motorcycle track having model motorcycles and rider figurines with life-like motion.

The general purpose of the present invention, which will be described subsequently in greater detail, is to provide a new motorcycle race track with moving rider figurines apparatus and method which has many of the advantages of the model race tracks mentioned heretofore and many novel features that result in a new motorcycle race track with moving rider figurines which is not anticipated, rendered obvious, suggested, or even implied by any of the prior art model race tracks, either alone or in any combination thereof.

To attain this, the present invention generally comprises a race track having a top face, a bottom face and a periphery formed therebetween defined by a pair of side walls to form an interior space. The top face of the race track has a plurality of parallel slots formed therein, as shown in FIG. 5. Each slot is defined by a pair of beveled edges for reasons that will soon become apparent. With continuing reference to FIG. 5, the bottom face of the race track is shown to have a plurality of planar guides coupled thereto along an entire length of the track. Each planar guide is positioned beneath one of the slots formed in the top face in alignment therewith. A pair of electrical contacts line an underside of the track on opposite sides of each slot. It should be noted that the power contacts of each slot are connected to a variable power source controllable by a user. Next provided is a plurality of carriage assemblies each including a rectangular top plate and a pair of side plates each coupled to a side edge of the top plate and depending downwardly therefrom. As shown in FIG. 2, a plurality of cut outs are formed in the side plates of each carriage assembly for rotatably receiving guide wheels. Such guide wheels are each rotatably mounted about a vertical axis. Each carriage assembly further includes a pair of roller contacts coupled to and extending upwardly from the top plate. In use, each carriage assembly is adapted to ride along one of the guides of the track such that the guide wheels abut opposite sides of the corresponding guide. Further, the roller contacts slidably abut the electrical contacts of the track for receiving power therefrom. As shown in FIG. 2, each carriage assembly further includes a power connector post mounted to the top plate. Such power connector post is equipped with a short vertical lower extent, a rearwardly extending intermediate extent and a forwardly extending upper extent. An adapter is mounted on an end of the upper extent of the power connector post. The adapter is connected to the roller contacts for receiving power therefrom. Also included is a plurality of miniature motorcycles each with a steering column connected to a front wheel and a pair of handle bars all of which are rotatable about a generally vertical axis. Each miniature motorcycle is further equipped with a rear drive mechanism connected to a rear wheel of the motorcycle for rotating the same upon the receipt of power. For receiving the upper extent of the power connector post of one of the carriage assemblies, a conduit is formed in an underside of the motorcycle. The conduit of each motorcycle has a port mounted therein which is connected to the drive mechanism. In use, the conduit is adapted to receive the power connector post such that port is connected with the adapter of the power connector post. By this interconnection, power may be directed to the drive mechanism upon the receipt thereof. Finally, a plurality of model motorcycle riders each have joints situated at a waist, wrists, elbows, shoulders, hips, knees thereof. The riders each have a pair of hands with apertures for releasably receiving the handle bars of the motorcycle. The riders are further equipped with a pair of feet hingably coupled to foot pegs of the motorcycle. With reference now to FIGS. 7–10, the riders each further include a control assembly including a linear arm pivotally coupled adjacent a central extent thereof to the motorcycle. A first end of the linear arm is pivotally coupled about a vertical axis to the rider. Further, a second end of the linear arm is pivotally coupled to a connector which is in turn fixedly coupled to the handle bars of the motorcycle. By this structure, upon the rotation of the steering column, the rider is shifted laterally with respect to the motorcycle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new motorcycle race track with moving rider figurines apparatus and method which has many of the advantages of the model race tracks mentioned heretofore and many novel features that result in a new motorcycle race track with moving rider figurines which is not anticipated, rendered obvious, suggested, or even implied by any of the prior art model race tracks, either alone or in any combination thereof.

It is another object of the present invention to provide a new motorcycle race track with moving rider figurines which may be easily and efficiently manufactured and marketed.

It is a further object of the present invention to provide a new motorcycle race track with moving rider figurines which is of a durable and reliable construction.

An even further object of the present invention is to provide a new motorcycle race track with moving rider figurines which is susceptible of a low cost of manufacture with regard to both materials and labor, and which accordingly is then susceptible of low prices of sale to the consuming public, thereby making such motorcycle race track with moving rider figurines economically available to the buying public.

Still yet another object of the present invention is to provide a new motorcycle race track with moving rider figurines which provides in the apparatuses and methods of the prior art some of the advantages thereof, while simultaneously overcoming some of the disadvantages normally associated therewith.

Still another object of the present invention is to provide a new motorcycle race track with moving rider figurines for providing a motorcycle track having model motorcycles and rider figurines with life-like motion.

Even still another object of the present invention is to provide a new motorcycle race track with moving rider figurines that include a race track and a plurality of carriage assemblies slidable along the track. A plurality of miniature motorcycles are each mounted on one of the carriage assemblies for being moved around the track.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
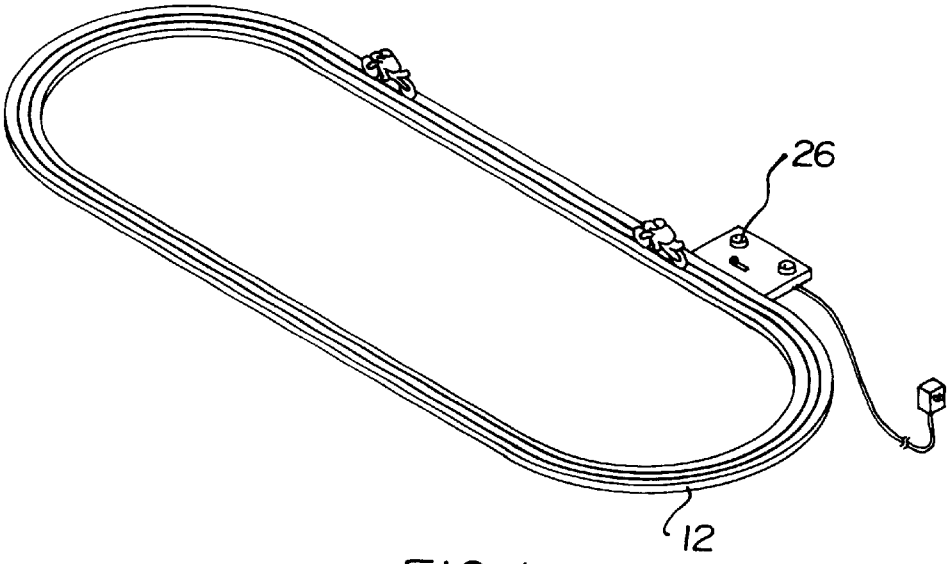
FIG. 1 is a perspective view of a new motorcycle race track with moving rider figurines according to the present invention.

With reference now to the drawings, and in particular to FIGS. 1 through 10 thereof, a new motorcycle race track with moving rider figurines embodying the principles and concepts of the present invention and generally designated by the reference numeral 10 will be described.

Figure 5:
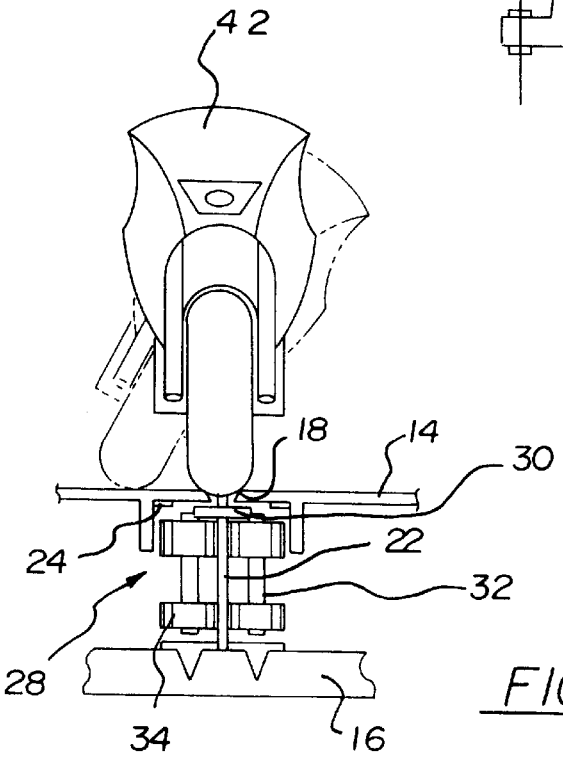
FIG. 5 is a front view of an optional tilting mechanism of the present invention in use.

The present invention, designated as numeral 10 includes an oval race track 12 having a top face 14, a bottom face 16 and a periphery formed therebetween defined by a pair of side walls to form an interior space. The top face of the race track has a plurality of parallel concentric slots 18 formed therein, as shown in FIG. 5. Each slot is defined by a pair of beveled edges for reasons that will soon become apparent.

With continuing reference to FIG. 5, the bottom face of the race track is shown to have a plurality of planar guides 22 coupled thereto along an entire length of the track. Each planar guide is positioned beneath one of the slots formed in the top face and in alignment therewith. A pair of electrical contacts 24 line an underside of the track on opposite sides of each slot. It should be noted that the power contacts of each slot are connected to a variable power source 26 controllable by a user.

Figure 2:
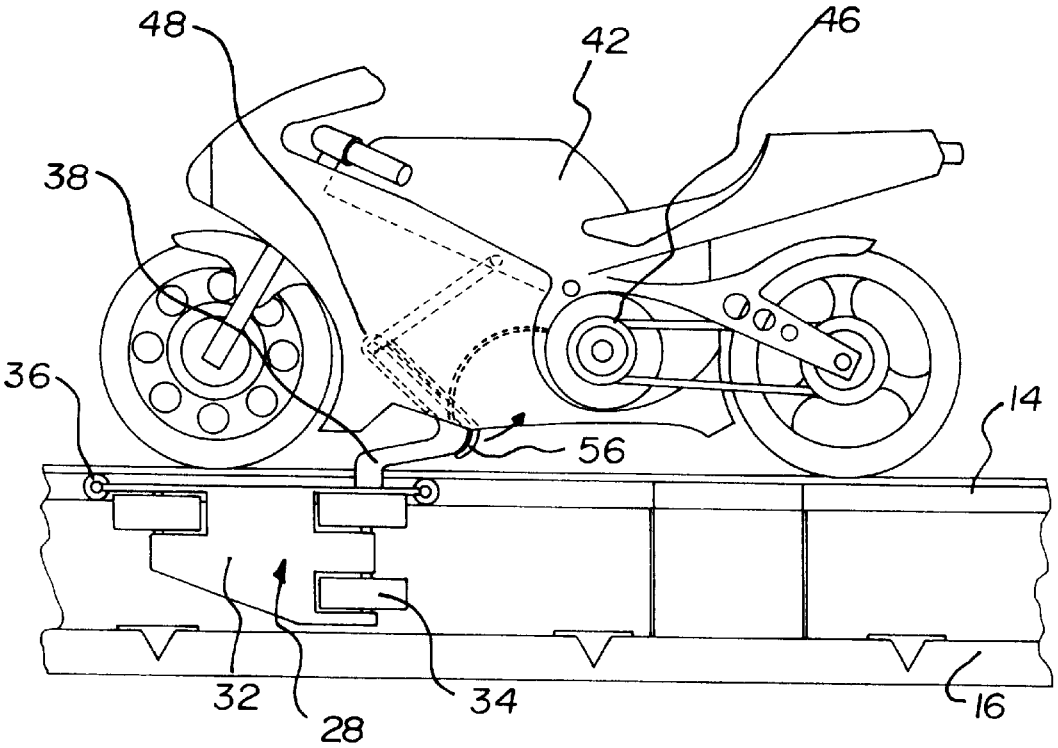
FIG. 2 is a side view of the present invention.
Figure 3:
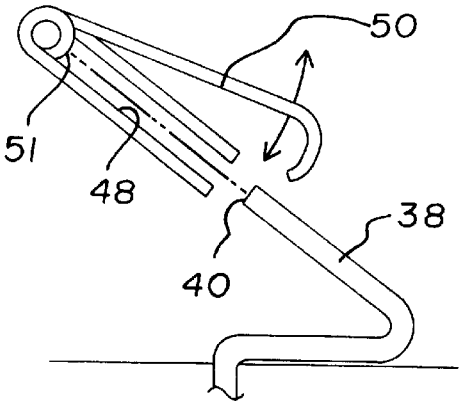
FIG. 3 is a side view of the conduit and resilient member of the present invention.

Next provided is a plurality of carriage assemblies 28 each including a rectangular top plate 30 and a pair of side plates 32 each coupled to a side edge of the top plate and depending downwardly therefrom. As shown in FIG. 2, a plurality of cut outs are formed in the side plates of each carriage assembly for rotatably receiving guide wheels 34. Such guide wheels are each rotatably mounted about a vertical axis. Each carriage assembly further includes a pair of roller contacts 36 coupled to and extending upwardly from the top plate.

In use, each carriage assembly is adapted to ride along one of the guides of the track such that the guide wheels abut opposite sides of the corresponding guide. Further, the roller contacts slidably abut the electrical contacts of the track for receiving power therefrom. As shown in FIG. 2, each carriage assembly further includes a power connector post 38 mounted to the top plate. Such power connector post is equipped with a short vertical lower extent, a rearwardly extending intermediate extent and a forwardly extending upper extent. An adapter 40 is mounted on an end of the upper extent of the power connector post. The adapter is connected to the roller contacts for receiving power therefrom.

Also included is a plurality of miniature motorcycles 42 each with a steering column 44 connected to a front wheel and a pair of handle bars all of which are rotatable about a generally vertical axis. Each miniature motorcycle is further equipped with a rear drive mechanism 46 connected to a rear wheel of the motorcycle for rotating the same upon the receipt of power. For receiving the upper extent of the power connector post of one of the carriage assemblies, a conduit 48 is formed in an underside of the motorcycle. Associated with the conduit is a resilient member 50 which extends therefrom for snappily engaging an interconnection between the upper and intermediate extent of the power connector post. Note FIG. 3.

The conduit of each motorcycle has a port 51 mounted therein which is connected to the drive mechanism. In use, the conduit is adapted to receive the power connector post such that port is connected with the adapter of the power connector post. By this interconnection, power may be directed to the drive mechanism upon the receipt thereof.

Finally, a plurality of model motorcycle riders 54 are provided each having joints situated at a waist, wrists, elbows, shoulders, hips, knees thereof. The riders each have a pair of hands with apertures for releasably receiving the handle bars of one of the motorcycles. The riders are further equipped with a pair of feet hingably coupled to foot pegs of the motorcycle.

Figure 8:
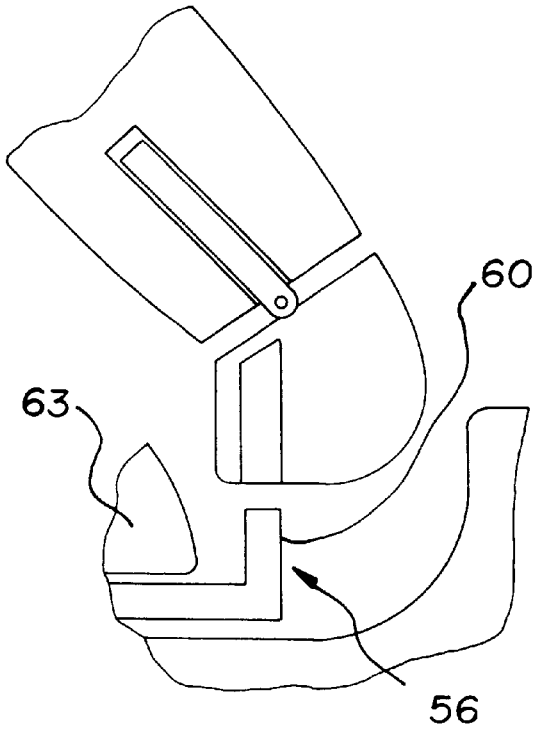
FIG. 8 is a side view of the interconnection of the motorcycle rider figurine and the motorcycle of the present invention.
Figure 9:
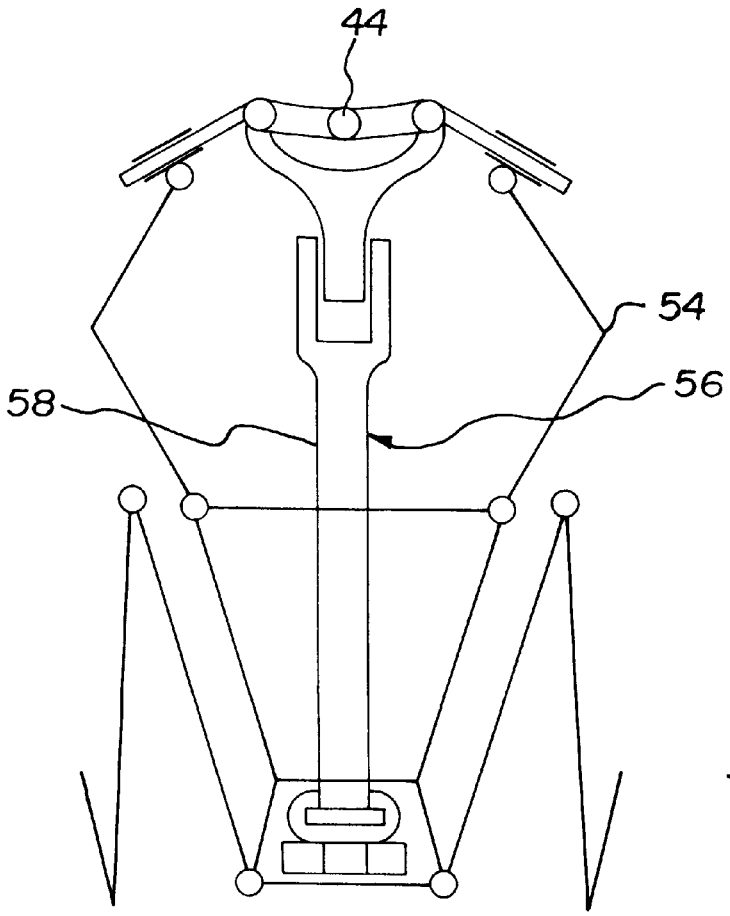
FIG. 9 is a schematic diagram of the interconnection of the motorcycle rider figurine and model motorcycle.
Figure 10:
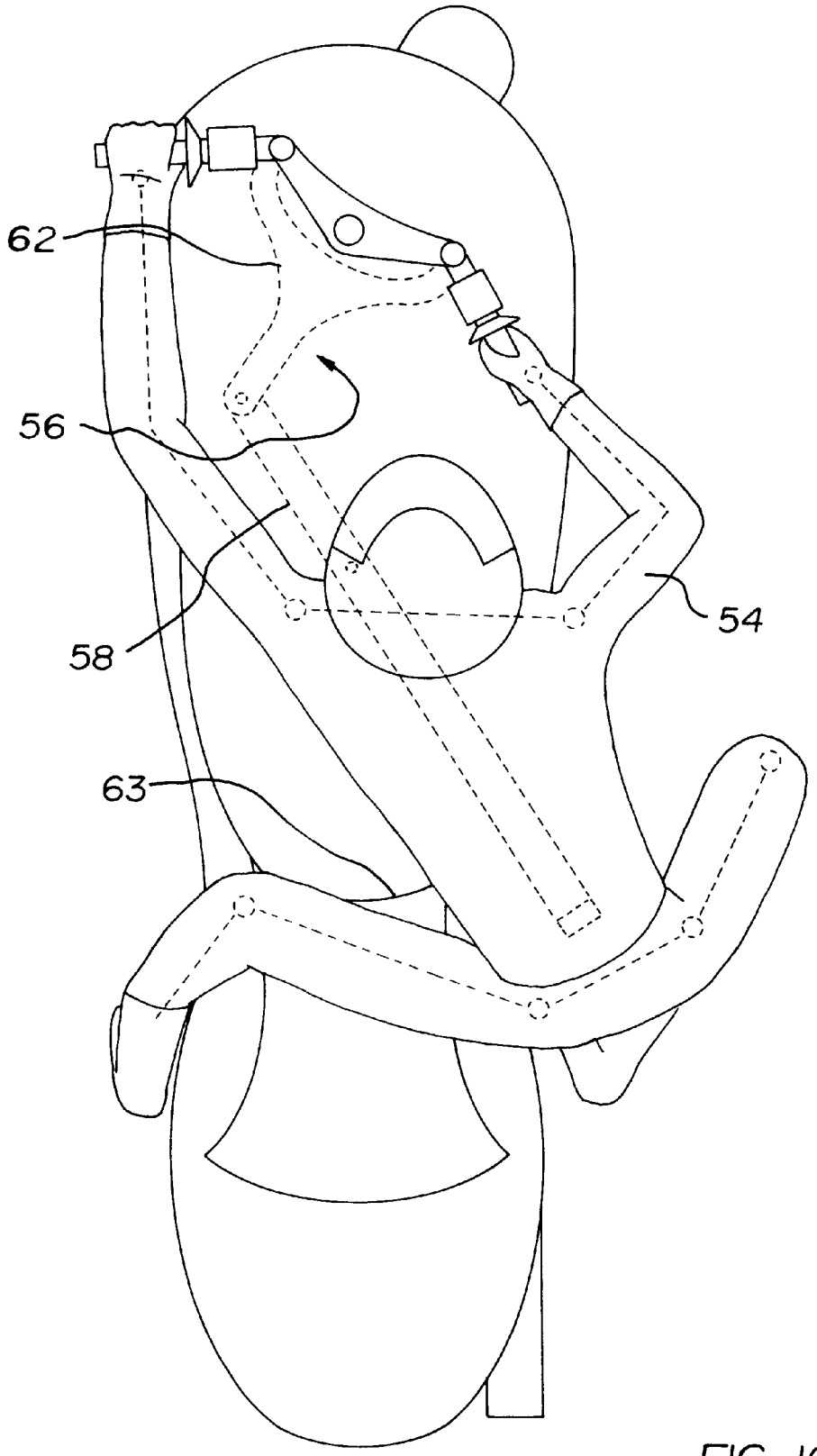
FIG. 10 is a top view of the interconnection of the motorcycle rider figurine and model motorcycle.

With reference now to FIGS. 7–10, the riders each further include a control assembly 56 including a linear arm 58 pivotally coupled adjacent a central extent thereof to the motorcycle. A first end of the linear arm is pivotally coupled about a vertical axis to the rider. This is preferably accomplished by way of a vertical post 60 which is received within a bore formed in an underside of the rider, as shown in FIG. 8. Further, a second end of the linear arm is pivotally coupled to a connector 62 which is in turn fixedly coupled to the handle bars of the motorcycle. By this structure, upon the rotation of the steering column, the rider is shifted laterally with respect to the motorcycle. When shifted, each of the joints of the rider accommodate such movement while maintaining the hands and feet connected to the motorcycle. Ideally, the linear arm 58 and connector 62 are slidable with a horizontally oriented slot 63 formed in the motorcycle. Such slot has a rear opening, as shown in FIGS. 8 & 10, for allowing the linear arm to extend therefrom to couple with the rider figurine.

It should be noted that the rotation of the steering column may be accomplished in many various ways. For example, the front wheel may be received between the beveled edges of the slots of the track and thereby be required to turn at each bend in the track. As an option, a servo may be placed within each of the model motorcycles for rotating the steering column by radio control or by additional control contacts which supplement the power contacts.

Figure 4:
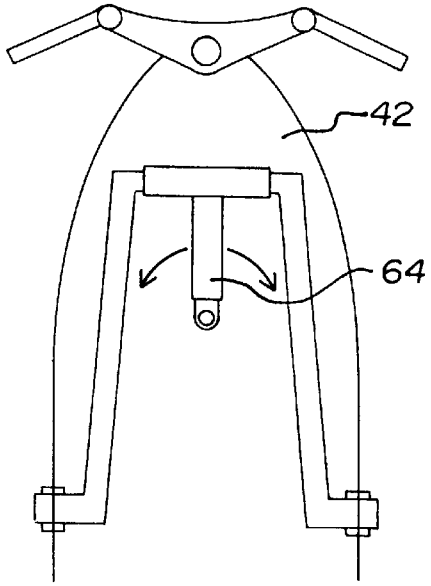
FIG. 4 is a front view of an optional tilting mechanism of the present invention.
Figure 6:
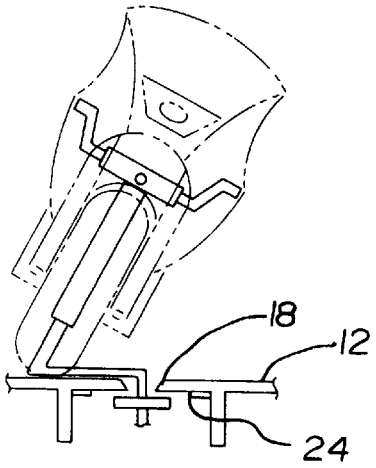
FIG. 6 is a front view of an another optional tilting mechanism of the present invention in use.
Figure 7:
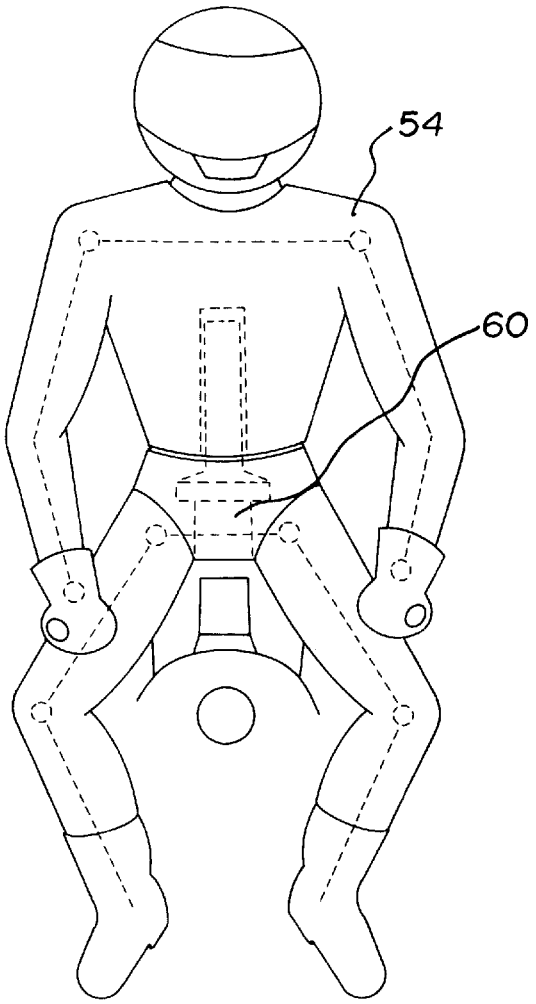
FIG. 7 is a front view of the motorcycle rider figurine of the present invention and the various joints thereof.

An additional option includes equipping the motorcycles with tilting mechanisms like that shown in FIGS. 4, 5 & 6 which tilt the motorcycle upon the rotation of the steering column. As best shown in FIG. 4, a support post 64 is pivotally mounted on the power connect post for allowing the same to pivot about a horizontal longitudinal axis. Similar to the steering control mechanism, the tilting control mechanism may be controlled by servos or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A model motorcycle race track system comprising, in combination:

a race track having a top face, a bottom face and a periphery formed therebetween defined by a pair of side walls to form an interior space, the top face of the race track having a plurality of parallel slots formed therein with each slot defined by a pair of beveled edges, the bottom face of the race track having a plurality of planar guides coupled thereto along an entire length of the track beneath one of the slots formed in the top face in alignment therewith, wherein a pair of electrical contacts line an underside of the track on opposite sides of each slot, the electrical contacts being connected to a power source;

a plurality of carriage assemblies each including a rectangular top plate and a pair of side plates each coupled to a side edge of the top plate and depending downwardly therefrom with a plurality of cut outs formed therein for rotatably receiving guide wheels which are each rotatably mounted about a vertical axis, each carriage assembly further including a pair of roller contacts coupled to and extending upwardly from the top plate, wherein each carriage assembly is movable along one of the guides of the track such that the guide wheels abut opposite sides of the corresponding guide and further the roller contacts slidably abut the electrical contacts of the track for receiving power therefrom, each carriage assembly further including a power connector post mounted to the top plate and having a short vertical lower extent, a rearwardly extending intermediate extent and a forwardly extending upper extent with an adapter mounted on an end thereof which is connected to the roller contacts for receiving power therefrom;

a plurality of miniature motorcycles each with a steering column connected to a front wheel and a pair of handle bars all of which are rotatable about a generally vertical axis, a rear drive mechanism connected to a rear wheel of the motorcycle for rotating the same upon the receipt of power, and a conduit formed in an underside of the motorcycle for receiving the upper extent of the power connector post of one of the carriage assemblies, the conduit having a port mounted therein which is connected to the drive mechanism for receiving the adapter of the power connector post and directing power to the drive mechanism upon the receipt thereof; and a plurality of model motorcycle riders each having joints situated at a waist, wrists, elbows, shoulders, hips, knees thereof, the riders each having a pair of hands with apertures for releasably receiving the handle bars of the motorcycle and a pair of feet hingably coupled to foot pegs of the motorcycle, the riders each further including a control assembly including a linear arm pivotally coupled adjacent a central extent thereof to the motorcycle with a first end pivotally coupled about a vertical axis to the rider and a second end pivotally coupled to a connector which is in turn fixedly coupled to the handle bars of the motorcycle, wherein upon the rotation of the steering column, the rider is shifted laterally with respect to the motorcycle.

2. A model motorcycle race track system comprising:

a race track having a top face, the top face of the race track having at least one slot formed therein, a guide extending beneath and along the slot;

a plurality of carriage assemblies slidable along the track and movable along the guide of the slot;

a plurality of miniature motorcycles each mounted on one of the carriage assemblies for being moved around the track; and a motorcycle rider figurine mounted on each motorcycle;

wherein the motorcycle rider figurine has joints for moving with the motorcycle; and wherein the motorcycle rider figurine shifts laterally upon the motorcycle turning.

3. A model motorcycle race track system as set forth in claim 2 wherein the carriage assemblies each slide along electrical contacts for supplying power to the motorcycle.

4. A model motorcycle race track system as set forth in claim 2 wherein the motorcycles are each removably mounted on the carriage assemblies.

5. A model motorcycle race track system as set forth in claim 4 wherein the motorcycles each have a conduit for releasably receiving a post mounted on one of the carriage assemblies.

6. A model motorcycle race track system as set forth in claim 5 wherein power is transmitted through the post.

7. A model motorcycle race track system comprising:

a race track having curved portions and straight portions, a slot being formed in the track and extending along the portions of the track;

a miniature motorcycle movable along the slot in the track; and a motorcycle rider figurine being mounted on the motorcycle, the motorcycle rider figurine having a plurality of joints movable with respect to the motorcycle such that the position of the motorcycle rider figurine shifts laterally with respect to the motorcycle when the motorcycle moves through a portion of curved track.

8. A model motorcycle race track system as set forth in claim 7 additionally comprising a carriage assembly slidable along the slot of the track, the motorcycle being mounted on the carriage assembly for being moved around the track.

9. A model motorcycle race track system as set forth in claim 8 wherein the carriage assembly is slidable along electrical contacts for supplying power to the motorcycle.

10. A model motorcycle race track system as set forth in claim 8 wherein the motorcycle is removably mounted on the carriage assembly.

11. A model motorcycle race track system as set forth in claim 8 wherein the motorcycle has a conduit for releasably receiving a post mounted on the carriage assembly.

12. A model motorcycle race track system as set forth in claim 11 wherein power is transmitted through the post.

* * * * *